United States Patent [19]

House et al.

[11] Patent Number: 4,684,202

[45] Date of Patent: Aug. 4, 1987

[54] OVERMOLDED ELECTRICAL CONNECTOR

[75] Inventors: Ronnalee House; Roger W. Kellams, both of Anderson, Ind.

[73] Assignee: General Motors Corporation, Detroit, Mich.

[21] Appl. No.: 899,877

[22] Filed: Aug. 25, 1986

[51] Int. Cl.[4] ..... H01R 13/504; H01R 13/514

[52] U.S. Cl. ..... 439/752; 264/263; 439/736

[58] Field of Search ..... 264/263; 339/206 R, 339/208, 210 R, 210 M, 218 R, 218 M

[56] References Cited

U.S. PATENT DOCUMENTS

| | | | |
|---|---|---|---|
| 3,141,054 | 7/1964 | Francis | 264/255 |
| 3,668,779 | 6/1972 | Turner | 339/220 R |
| 3,705,831 | 12/1972 | Sayre et al. | 264/263 |
| 3,945,708 | 3/1976 | Griffin | 339/218 R |
| 4,043,630 | 8/1977 | Suverison et al. | 339/63 M |
| 4,257,666 | 3/1981 | Schauer et al. | 339/196 R |

FOREIGN PATENT DOCUMENTS

| | | | |
|---|---|---|---|
| 1640302 | 4/1970 | Fed. Rep. of Germany | 339/208 |
| 376553 | 5/1964 | Switzerland | 339/208 |

*Primary Examiner*—Gil Weidenfeld
*Assistant Examiner*—Gary F. Paumen
*Attorney, Agent, or Firm*—C. R. Meland

[57] ABSTRACT

An overmolded electrical connector in which a flexible spring finger contact is encased in a rigid plastic material in such a manner that the spring finger is not restrained from flexing by the rigid plastic material. The connector comprises an assembly that includes a terminal block, a cover and a terminal that has the flexible spring finger. The terminal is assembled to the terminal block such that the spring finger is located in a cavity in the block. The cover is now attached to the block and the assembly is overmolded by injection molding apparatus. The cover and block have a cooperating tongue and groove to prevent molding material from entering the cavity that contains the spring finger. The cover has crush ribs that engage a tab portion of the terminal that extends from the cavity to a point exterior of the assembly.

4 Claims, 5 Drawing Figures

OVERMOLDED ELECTRICAL CONNECTOR

This invention relates to an overmolded electrical connector that has a spring component contact that is flexed whenever the contact is connected to a mating terminal or contact.

Whenever an electrical device is packaged, by way of an injection molding process, the method of making an electrical connection to the component or components inside the overmolding becomes a problem. In order to make a reliable and durable connection, that require repeatable engagement and disengagement, mating terminals are utilized such as male and female terminals. One or both of the mating terminals must have a spring-component that is allowed to flex during the mating of the terminals and maintain its flexibility throughout the life of the electrical connection.

When an electrical connection is to be made between two electrical devices the terminal with the spring-component cannot be injection overmolded unless the overmolding material is flexible enough to allow the desired amount of movement of the terminal spring-component. Flexible overmolding materials typically are not durable enough to encase electrical devices. If the overmolding material must be rigid then the spring-component terminal must be outside the overmolding since if rigid material is utilized the material would prevent the spring-component from flexing. One method of extending the electrical circuit outside the overmolding is to provide a metal blade which may be a portion of a lead frame, or a wiring pigtail that protrudes from the device at the overmolding parting line. Such a blade or pigtail can be sealed off in the mold during the injection molding process so that it is clean of overmolding material and can be used as the electrical termination. The terminal spring-component outside the overmolding can either be built into the blade or added as a separate terminal. These methods of termination are lacking in reliability and are costly, due to the added connections and components to the electrical circuit, as compared to an overmolded terminal that has the spring-component built in.

Accordingly, it is an object of this invention to provide an overmolded electrical connector that includes a spring-component wherein the spring-component is encased by a rigid plastic material in such a manner that the spring-component is not restrained from flexing. In carrying this object forward an assembly is provided wherein a terminal block and a cover member enclose a terminal that has flexible contact arms. The terminal block has one or more cavities for receiving the flexible contact arms. The terminal has a tab portion which extends through a slot formed in the terminal block. The cover member is provided with a tongue which fits within a complementary groove formed in the terminal block so that when the cover is secured to the terminal block the tongue is positioned within the groove. Further, the cover is provided with crush ribs which engage the tab portion of the terminal. When the terminals have been assembled to the terminal block and the cover secured to the terminal block this assembly is placed in an injection molding apparatus to encase the assembly. The tongue and groove arrangement prevents molding material from being forced into the terminal block cavity that contains the spring arms of the terminal and the crush ribs force the tab against a surface of the terminal block to prevent molding material from passing by the tab portion of the terminal and into the cavity.

IN THE DRAWINGS

Figure 1:
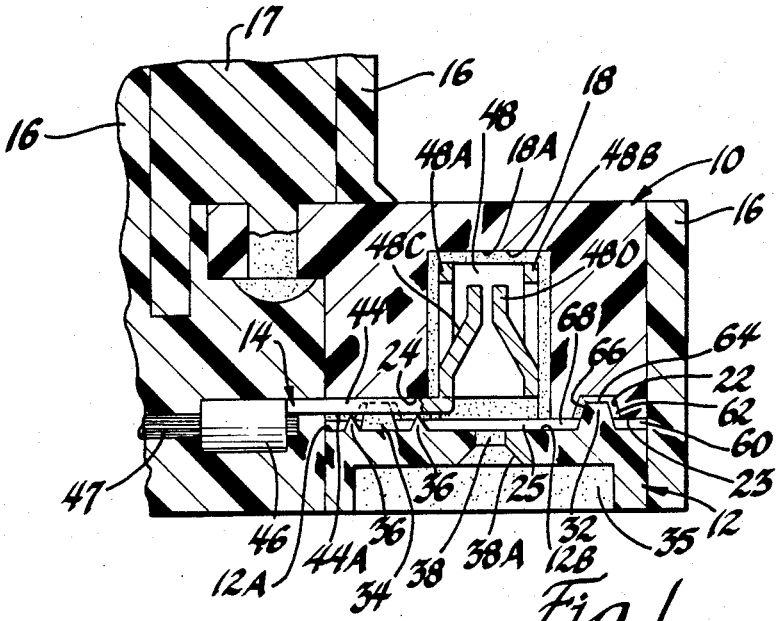
FIG. 1 is a sectional view of an overmolded electrical connector made in accordance with this invention.
Figure 4:
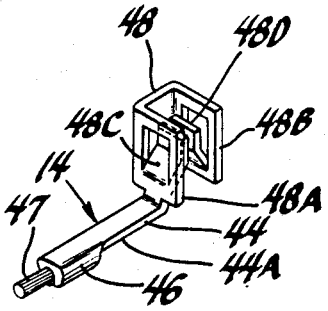
FIG. 4 is a perspective view of an electrical terminal that forms a part of the electrical connector shown in FIG. 1.

Referring now to the drawings, the electrical connector of this invention includes a terminal block generally designated by reference numeral 10, a cover member generally designated by reference numeral 12 and a terminal generally designated by reference numeral 14. These parts are assembled together and then are overmolded with a molding material which has been designated by reference numeral 16 in FIG. 1. The terminal block 10 is mechanically connected to a portion 17 of a plastic housing of an electrical device. The overmolding material 16 is a hard, rigid thermoplastic or thermosetting plastic material.

The terminal block 10 is formed from a molded plastic material and has two cavities 18 that are each adapted to receive a female terminal in a manner to be described. The cavities 18 do not extend through the terminal block 10 but rather extend to an internal surface 18A which is illustrated in FIG. 1.

Figure 2:
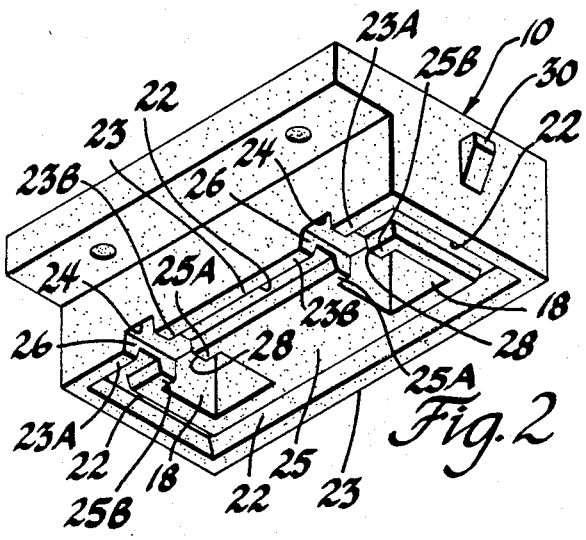
FIG. 2 is a perspective view of a terminal block which is a part of the electrical connector shown in FIG. 1.

The terminal block 10 has a groove or channel designated by reference numeral 22 and a surface 23 located adjacent groove 22. The block 10 has a surface 25 that is located inside of groove 22. In addition, the terminal block 10 has a pair of flat surfaces or bridge portions 24 that extend across the groove 22. The surfaces 24 also extend through channels or slots 26 and 28 formed in the terminal block 10. The terminal block 10 has a pair of lugs 30, one of which is illustrated in FIG. 2. These lugs are adapted to be received within latch arms that form a part of the cover 12 in a manner that will be described.

Figure 3:
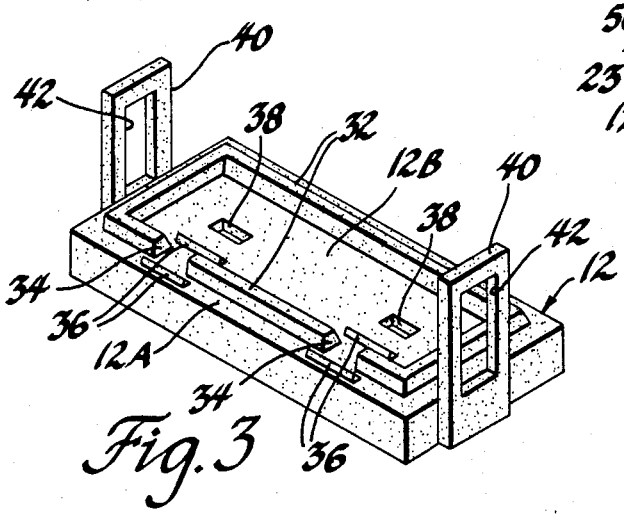
FIG. 3 is a perspective view of a cover member which forms a part of the electrical connector shown in FIG. 1.

The cover 12 is formed from a molded plastic material and has an axially extending tongue or rib 32 which is interrupted at areas to form slots 34. The rib 32 is bounded by a surface 12A and the rib is disposed about surface 12B. Aligned with the slots 34 in the rib 32 are pairs of V-shaped crush ribs 36. The crush ribs are spaced from each other as illustrated in FIG. 3 and extend axially beyond the edges of slots 34. The cover 12 has a rectangular recess 35, illustrated in FIG. 1.

The cover 12 has a pair of terminal access holes or openings 38 that extend entirely through the cover 12. As illustrated in FIG. 1, the access hole 38 has a chamfered portion 38A. The openings 38 are adapted to receive male terminals in a manner that will be described.

The cover 12 has two flexible latch arms 40, each provided with an opening 42. When the cover member 12 is assembled to the terminal block 10 the lugs 30 snap into the latch arms 40 to secure the cover 12 to the terminal block 10. The latch arms 40 can deflect outwardly as the cover 12 is assembled to the terminal block 10 and then the lugs 30 snap into the openings 42.

The terminal 14 is formed of electrically conducting material such as brass. The terminal 14 has a flat rectangular tab portion 44, a tubular portion 46 and a female terminal portion 48 that is comprised of arms 48A and 48B. The arms 48A and 48B respectively have inwardly struck deflectable resilient spring arms 48C and 48D which are adapted to engage a male terminal.

The method of forming the electrical connector illustrated in FIG. 1 will now be described. In forming the electrical connector of FIG. 1 the portion 46 of a terminal 14 is crimped into engagement with a conductor 47. The terminals 14 are then assembled to the terminal block 10 such that the female terminal portions 48 are inserted into the cavities 18 so that the female terminal portion 48 is positioned as illustrated in FIG. 1. When the terminals 14 are assembled to the terminal block 10 the tab portions 44 extend through the slots 26 and 28 and the tab portion 44 engages the surface 24. The depth of slots 26 and 28 and the thickness of tab portion 44 are such that with the tab portion engaging a surface 24 the surface 44A of tab portion will be substantailly flush with surfaces 23 and 25. The width of the tab portion 44, relative to the width of slots 26 and 28, is such that the side edges of tab 44 have a tight fit with the edges of slots 26 and 28.

When the terminals 14 have been assembled to the terminal block 10 the cover member is assembled to the terminal block 10. This is accomplished by fitting the tongue or rib 32 of the cover into the slot or groove 22 of the terminal block 10. When the cover is assembled to the terminal block 10 the latch arms 40 deflect outwardly and eventually the lugs 30 snap into the openings 42 of the latch arms 40 so that the lugs and latch arms now serve to secure the cover member 12 to the terminal block 10. When the cover 12 is assembled to block 10 tab portions 44 of terminals 14 extend through cover slots 34.

Figure 5:
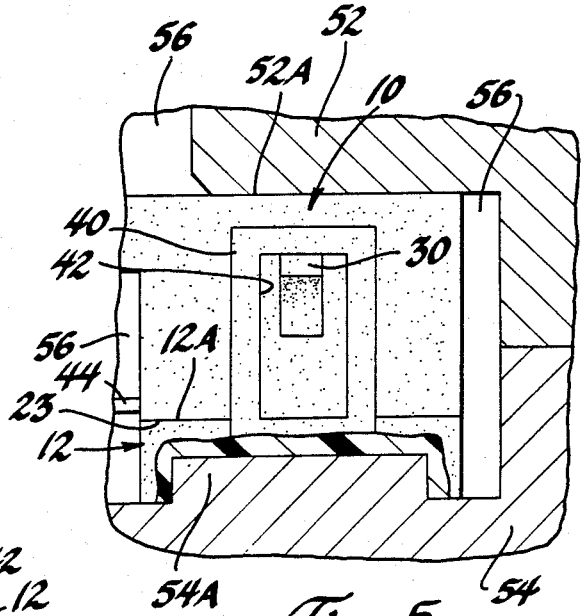
FIG. 5 illustrates injection molding apparatus for overmolding the electrical connector of this invention.

With the parts assembled in a manner that has been described, the terminal block 10 and attached cover 12 are placed in the mold parts of an injection molding apparatus which is illustrated in FIG. 5. The molding apparatus shown in FIG. 5 comprises a pair of mold parts or mold halves 52 and 54 which are closed when the assembly is overmolded. The assembly is placed in the mold such that the cover 12 engages an inner surface of the mold part 54. This mold part has a rectangular portion 54A which fits into the rectangular recess 35 of cover 12 to prevent molding material from entering recess 35. In this regard, the surfaces of portion 54A engage the inner surface defining the recess 35. The mold part 52 has a surface 52A which engages the terminal block 10. When the mold parts 52 and 54 are brought together they define a cavity 56 which receives molding material. The shape of cavity 56 is such that when molding material is injected into the cavity 56 the molding material engages the entire outer surfaces of parts 10 and 12 except for the portions of these parts that are engaged by the inner surfaces of mold parts 52 and 54. When the mold parts 52 and 54 are brought together they force surfaces of the terminal block 10 into engagement with surfaces 23 and surface 12B engages surface 25. In FIG. 1, the outer surface of the rib 32 is shown slightly spaced from the inner surface of the groove 22 formed in the terminal block 10. Depending upon the relative dimensions of the rib 32 and groove 22 the rib 32 is ordinarily engaged with the inner walls of the groove 22. However, if the dimensions of the parts are such that the outer surface of rib 32 is slightly spaced from the inner surface of groove 22 the molding material will nevertheless be prevented from entering the cavities 18 when molding material is injected into cavity 56. The reason for this is that any molding material that might pass between the exterior of the assembly and the cavities 18 must transverse a path identified by reference numerals 60, 62, 64, 66 and 68. It can be seen that this is a tortuous path which changes direction and increases the distance between the exterior of the assembly and the cavity 18. Thus, if this path is not tightly sealed by engagement of the parts the molding material will solidify in this path before reaching the cavity 18. In regard to the dimensions of the mating parts it is noted that they can vary due to manufacturing tolerances and the ability of the molding equipment to form parts 10 and 12 to specified dimensions.

When the parts 10 and 12 are forced together by the molding apparatus the crush ribs 34 engage surface 44A of the tab portion 44 of the terminal as illustrated in FIG. 1 and they also respectively engage surface areas 23A and 23B and 25A and 25B of block 10. The opposite side of the tab portion 44 is engaged by the surface 24 of the terminal block 10. As the two parts are forced together and again, depending upon the relative dimensions of the parts, it is possible that the ribs 36 will be deformed to allow surfaces of the two parts to be tightly engaged. Since the tab portion 44 is tightly clamped between the ribs 36 and the surface 24 the molding material that is injected into the cavity 56 cannot pass by tab portion 44 and into cavity 18 of the terminal block 10. It is possible that the parts will be so dimensioned that the ribs 34 are not deformed and in such a case they tightly engage the tab portion 44 to prevent molding material from entering the cavity 18.

In FIG. 1 the conductor 47 is shown electrically connected to one of the terminals 14. This electrical connection can be made by various known methods other than by crimping. It will of course be appreciated that the other terminal of the assembly is likewise connected to an electrical conductor and these conductors are encased by the overmolding material 16. The conductors, like conductor 47, can be connected for example to the primary winding of an ignition coil for an ignition system of an internal combustion engine. The ignition coil may also be encapsulated in the molding material 16 and this has not been illustrated in order to simplify the explanation of this invention.

The openings 38 in the cover plate 12 are aligned with the spring contact arms 48C and 48D of the female terminal portions 48. These openings are adapted to receive male terminals of an electrical connector which are inserted through the openings 38 and into the spring contact arms 48C and 48D so as to be engaged thereby. The male terminals may be detached by withdrawing them through the openings 38.

The tongue and groove arrangement (32, 22) serves to prevent molding material from entering cavities 18 and also keeps parts 10 and 12 f rom slipping relative to each other when they are being overmolded.

The terminal block 10 has been illustrated and described as having two cavities 18. This invention can be used where the terminal block would have only one cavity or more than two cavities.

The terminal 14 has been illustrated and described as having two spring fingers 48C and 48D. This invention can be used where only one spring finger would be utilized.

At the expense of some reiteration, the tightness of the fit between engaged surfaces of parts 10 and 12, when the mold parts 52 and 54 force these parts together, will depend upon the relative dimensions of the parts 10 and 12 which can vary due to dimension tolerances and whether parts have been made to specified dimensions. In any event, the tortuous path 60, 62, 64, 66 and 68 will prevent molding material from entering cavities 18. In addition, in the final overmolded device, the gap, if any gap exists between surfaces of parts 10 and 12, will not be as large as shown in FIG. 1. The gap has been shown to depict the tortuous path 60, 62, 64, 66 and 68.

The embodiments of the invention in which an exclusive property or privilege is claimed are defined as follows:

1. An electrical connector assembly that is adapted to be overmolded with a plastic covering material comprising, a terminal block formed of electrical insulating material having at least one cavity, a groove formed in one face of said terminal block disposed about said cavity, a cover member secured to said terminal block having a tongue portion located within said groove, an electrical terminal having at least one flexible spring finger portion disposed within said cavity and having a tab portion that extends from said cavity to a point exterior of said terminal block and cover, said tab portion extending through a slot formed in said terminal block, said cover member having at least one crushable rib that is engageable with one side of said tab portion, the opposite side of said tab portion being engageable with a surface on said terminal block, said assembly being adapted to be placed in molding apparatus that during the molding operation forces the cover member and terminal block together, said tab portion being clamped between said crushable rib and said surface to prevent molding operation and said tongue and groove operating to prevent molding material from entering said cavity during a molding operation.

2. The connector assembly according to claim 1 where the cover member has a terminal access opening aligned with said spring finger portion.

3. The connector assembly according to claim 1 where the terminal block and cover have cooperating latching means for securing the cover to the terminal block.

4. The connector assembly according to claim 1 where a pair of spring contact arms are disposed within said cavity that provide a female terminal that is adapted to engage a male terminal.

* * * * *

UNITED STATES PATENT AND TRADEMARK OFFICE

CERTIFICATE OF CORRECTION

PATENT NO. : 4,684,202

DATED : August 4, 1987

INVENTOR(S) : Ronnalee House and Roger W. Kellams

It is certified that error appears in the above—identified patent and that said Letters Patent is hereby corrected as shown below:

Column 3, line 52, delete "surface" and insert -- surfaces --;

Column 3, line 63, after "surfaces" insert --of the cover 12. Thus, surface 12A engages surface --.

Column 4, line 8, delete "transverse" and substitute -- traverse --.

Column 5, line 8, after "whether" insert -- the --.

Column 6, line 12, after "molding" insert -- material from entering said cavity during a molding --.

Signed and Sealed this

Twenty-ninth Day of December, 1987

*Attest:*

DONALD J. QUIGG

*Attesting Officer*

*Commissioner of Patents and Trademarks*